US009113239B2

(12) United States Patent
Kim

(10) Patent No.: US 9,113,239 B2
(45) Date of Patent: Aug. 18, 2015

(54) ELECTRONIC DEVICE AND METHOD FOR SELECTING MICROPHONE BY DETECTING VOICE SIGNAL STRENGTH

(71) Applicant: Samsung Electronics Co., Ltd., Gyeonggi-do (KR)

(72) Inventor: Kun-Hee Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 175 days.

(21) Appl. No.: 13/973,278

(22) Filed: Aug. 22, 2013

(65) Prior Publication Data

US 2014/0056439 A1 Feb. 27, 2014

(30) Foreign Application Priority Data

Aug. 23, 2012 (KR) ..... 10-2012-0092653

(51) Int. Cl.
*H04R 3/00* (2006.01)

(52) U.S. Cl.
CPC ..... *H04R 3/00* (2013.01); *H04R 3/005* (2013.01); *H04R 2420/01* (2013.01); *H04R 2420/07* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 6,941,161 | B1 * | 9/2005 | Bobisuthi et al. | 455/569.1 |
| 8,958,571 | B2 * | 2/2015 | Kwatra et al. | 381/94.1 |
| 2005/0107130 | A1 | 5/2005 | Peterson | |
| 2008/0146289 | A1 * | 6/2008 | Korneluk et al. | 455/569.1 |
| 2008/0175399 | A1 * | 7/2008 | Kim et al. | 381/57 |
| 2009/0252344 | A1 * | 10/2009 | Mao et al. | 381/74 |
| 2010/0195841 | A1 | 8/2010 | Pires | |

FOREIGN PATENT DOCUMENTS

| | | | |
|---|---|---|---|
| KR | 10-0812071 | B1 | 3/2008 |
| KR | 10-2011-0065052 | A | 6/2011 |

* cited by examiner

*Primary Examiner* — Paul Huber
(74) *Attorney, Agent, or Firm* — Cha & Reiter, LLC

(57) ABSTRACT

An electronic device and method thereof for selecting a mic by detecting voice signal strengths at respective microphones. The electronic device has first and second mics and is communicatively connected to a headset having a third mic. Voice signal strengths received at the respective first, second, and third mics are detected. A determination is made as to which one of the first, second, and third mics detects the greatest voice signal strength. All of the mics are disabled for communication except for the mic detecting the greatest voice signal strength.

20 Claims, 10 Drawing Sheets

ELECTRONIC DEVICE AND METHOD FOR SELECTING MICROPHONE BY DETECTING VOICE SIGNAL STRENGTH

CLAIM OF PRIORITY

The present application claims the benefit under 35 U.S.C. §119(a) to a Korean patent application filed in the Korean Intellectual Property Office on Aug. 23, 2012, and assigned Serial No. 10-2012-0092653, the entire disclosure of which is hereby incorporated by reference.

TECHNICAL FIELD

The present disclosure relates generally to an electronic device capable of receiving a voice input signal through any of plural microphones installed therein or connected thereto via a headset.

BACKGROUND

A recent trend in today's electronic communication devices has been to communicatively connect the electronic device main body to an accessory headset, thereby allowing for hands-free telephonic communication or recording/reproduction. A headset is an accessory that includes both an earphone for listening, e.g., headphones or one or two earbuds, as well as a microphone ("mic") for receiving a user's voice input. Both wired and wireless headset designs are widely available. The headset microphone converts the user's voice input to a suitable analog or digital signal which is forwarded for processing to communication circuitry within the base unit housing of the electronic device.

A user can connect the headset to the electronic device and listen to sound such as sound source or video saved in the electronic device, or the voice of another party during a telephone call. When the user listens to music, etc. using the earphone connected to the electronic device, he/she can concentrate on the corresponding sound regardless of a surrounding environment and does not generate noise to other people around him/her. Also, in the case of a mobile phone, the user may make a call using the microphone of the headset which is maintained hands-free in proximity to the user's lips, rather than using a speakerphone on the phone's housing or continually holding the phone to his ear.

However, when the headset is connected (wirelessly or in a wired connection) to the electronic device, the mic(s) on the device housing is automatically disabled. The user, however, may occasionally try the call using a mic on the housing even though it's disabled and only the mic of the earphone is enabled. That is, when the headphone is still connected, the user might speak into the phone directly rather than the headphone mic, out of habit. As a result, the voice signal received by the headset mic may be of poor quality and barely discernible by the other party.

SUMMARY

An aspect of the present disclosure is to provide an apparatus and a method for selecting and enabling a mic of best performance when a call is connected with a headset accessory.

Another aspect is to provide an apparatus and a method for detecting a user position which changes in real time and automatically selecting, among a plurality of mics, a mic of the best receive sensitivity, to thus enhance user's convenience.

Yet another aspect is to provide an apparatus and a method for detecting a slight position change of a main mic and a sub mic using an acceleration sensor.

In exemplary embodiments, an electronic device and method thereof for selecting a mic by detecting voice signal strengths at respective microphones are provided. The electronic device has first and second mics and is communicatively connected to a headset having a third mic. Voice signal strengths received at the respective first, second, and third mics are detected. A determination is made as to which one of the first, second, and third mics detects the greatest voice signal strength. All of the mics are disabled for communication except for the mic detecting the greatest voice signal strength.

In various embodiments:

The operating method may further include confirming that a call is connected; and initially enabling the first, second, and third mics.

The first mic may be a main mic.

The second mic may be a sub mic.

The third mic may be a mic of a wired headset or a wireless headset.

The determining of which one of the first, second, and third mics detects the greatest voice signal strength may include determining that the third mic is a mic of a wired headset; converting a first analog voice signal detected by the first mic to a first digital signal; converting a second analog voice signal detected by the second mic to a second digital signal; converting a third analog voice signal received from the wired headset to a third digital signal; and comparing levels of the converted first, second, and third digital signals.

The determining of which one of the first, second, and third mics detects the greatest voice signal strength may include determining that the third mic is a mic of a wireless headset; converting a first analog voice signal detected by the first mic to a first digital signal; converting a second analog voice signal detected by the second mic to a second digital signal; converting a near field communication (NFC) signal received from the wireless headset to a third digital signal; and comparing levels of the converted first, second, and third digital signals.

According to another aspect of the present invention, an electronic device having first and second mics is communicatively connectable to a headset having a third mic. The first, second and third mics each detect a respective voice signal strength. A processor unit determines which one of the first, second, and third mics detects the greatest voice signal strength, and disabling all mics for communication except for the mic detecting the greatest voice signal strength.

Other aspects, advantages, and salient features of the disclosure will become apparent to those skilled in the art from the following detailed description, which, taken in conjunction with the annexed drawings, discloses exemplary embodiments thereof.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, like reference numerals will be understood to refer to like parts, components and structures.

DETAILED DESCRIPTION

The following description with reference to the accompanying drawings is provided to assist in a comprehensive understanding of exemplary embodiments of the invention as defined by the claims and their equivalents. It includes various specific details to assist in that understanding but these are to be regarded as merely exemplary.

Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Figure 1:
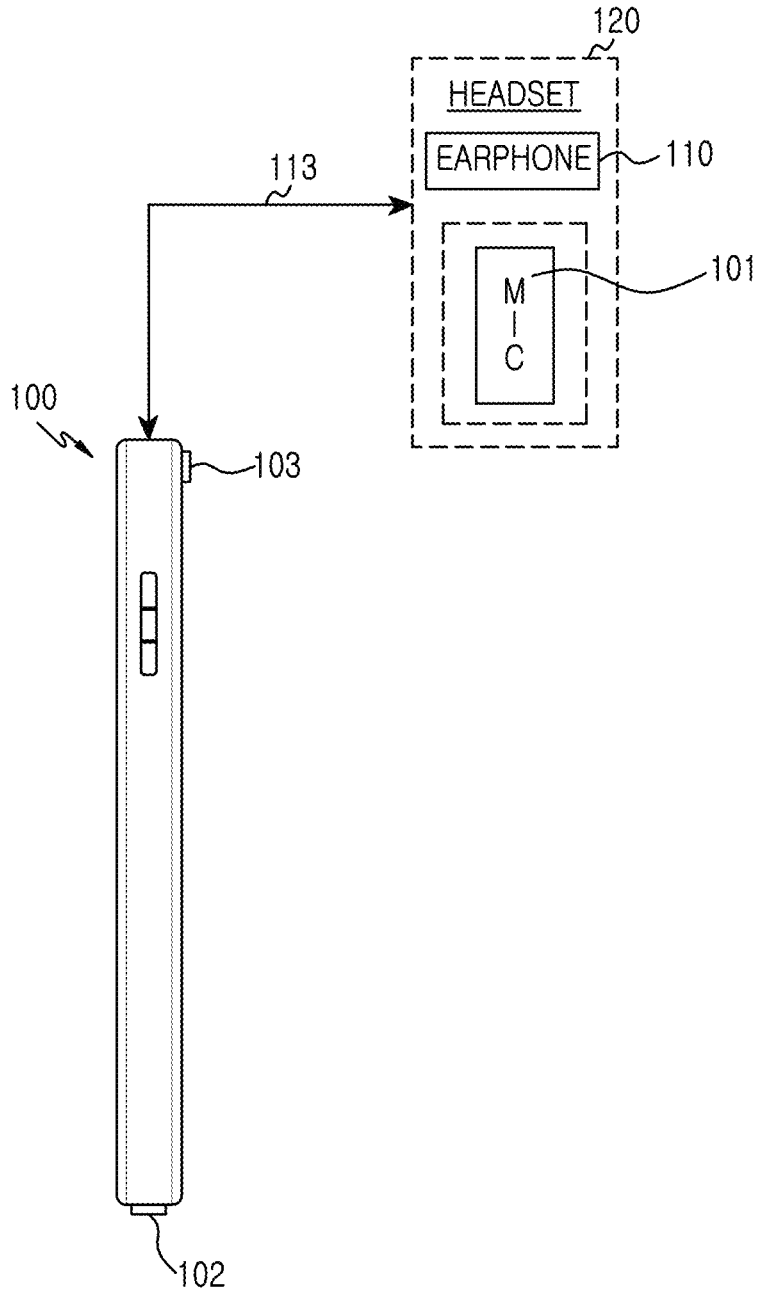
FIG. 1 illustrates an electronic device configured to select a mic by detecting voice signal strength according to an exemplary embodiment of the present invention.

FIG. 1 illustrates an electronic device, 100, configured to select a microphone (mic) by detecting voice signal strength according to an exemplary embodiment of the present invention. Electronic device 100 is communicatively connectable with an accessory headset 120 via a connection path 113. If headset 120 is a wireless headset, connection path 113 is wireless; if headset 120 is a wired headset and plugged into a port of device 100, connection path 113 is a cable.

Electronic device 100 can be embodied as a portable, handheld wireless communication device such as a smart phone or tablet computer with telephony capability. In the following description, device 100 will be described in the context of a portable phone; however, other applications are also possible. Electronic device 100 will also be referred to interchangeably as a "base unit" that connects to an accessory headset.

In the description of embodiments hereafter, it is assumed that a call is connected with the wire or wireless headset 120 communicatively connected to electronic device 100. That is, device 100 is assumed to send/receive voice signals of the call to the headset 120. Hereafter, operating methods of device 100 in such communication with headset 120 are explained in detail.

Headset 120, whether of wireless or wired type design, includes an earphone 110 for providing an audible output signal, and a mic 101, hereafter referred to as a "third mic". The wireless type of headset can be any device supporting Near Field Communication (NFC) such as Bluetooth and Zigbee. The wireless headset transmits a modulated data signal representing an analog voice signal detected by the third mic 101 to the base unit 100 using NFC.

Device 100 can include a first mic 102 and a second mic 103. In FIG. 1, the first mic 102 is shown disposed at a bottom surface of the device 100; however, in other embodiments it may be disposed at a lower part of the front side of device 100. The second mic 103 is shown disposed in an upper part of the rear side of device 100; in other embodiments, it may be disposed at the top surface or a top portion of the front surface of device 100. Herein, the first mic 102 may be referred to as a main mic, and the second mic 103 may be referred to as a sub mic. (The main mic and the sub mic are designed equally) Since device 100 includes the two mics 102, 103, it may be called a dual mic device. Hereafter, an operating method of the electronic device 100 is explained on the assumption that device 100 receives a call request or is executing a call with the headset 120 communicatively connected thereto.

As discussed above, in related art mobile phones, when a headset is connected to the base unit, the mic on the base unit is disabled. However, in accordance with embodiments herein, rather than automatically disabling the base unit mics, voice signal strengths at each of the base unit mics and the headset mic are measured, and a mic receiving the highest voice signal strength is selected to be enabled for communication while the other mics are disabled for communication. In this manner, optimized performance with the best quality voice signal can be ensured.

Figure 2:
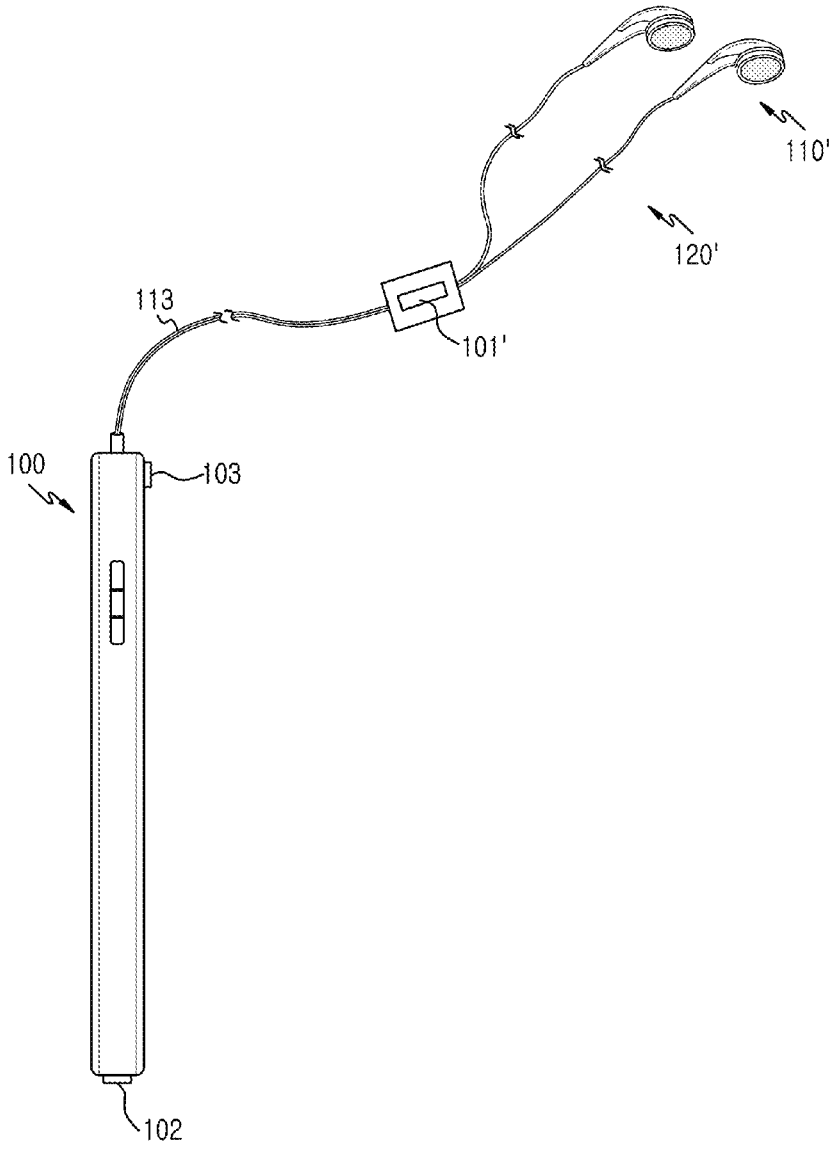
FIG. 2 illustrates a wired type headset connected to the electronic device according to an exemplary embodiment of the present invention.

Referring momentarily to FIG. 2, an example of device 100 being connected to a wired type headset 120' is shown. Here, the communication path between the headset 120' and base unit is a cable 113'. Earphone 110' is exemplified as a two earbud type earphone. In an alternative embodiment, only one earbud is employed. The microphone 101' is suitably disposed connected to cable 113' at a location designed to be proximate to a user's lips.

Figure 3:
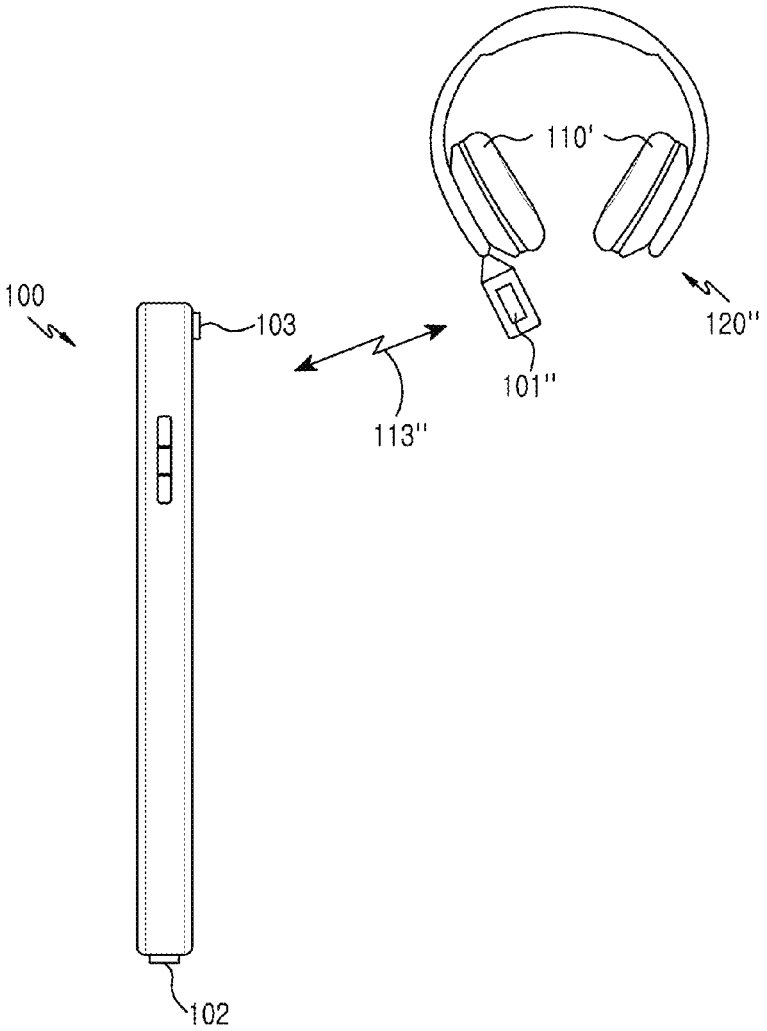
FIG. 3 illustrates a wireless type headset connected to the electronic device according to an exemplary embodiment of the present invention.

Referring momentarily to FIG. 3, an embodiment of a wireless type headset 120" is illustrated. Wireless headset 120" includes dual-ear type headphones 110", and a microphone 101" connected to a frame that supports the pair of headphones. Here, the communication path between the headset 120" and the base unit 100 is a NFC wireless path 113".

The following description of exemplary methods of the present disclosure is applicable to both wired and wireless headsets, as in the examples of FIGS. 2 and 3.

With continuing reference to FIG. 1, device 100 can confirm a call connection and initially enable all three mics 101-103 in order to detect which of the mics is capable of providing the best performance in the current environment. With all three mics initially enabled, device 100 detects voice signal strength around the first, second, and third mics 102, 103, and 101. In this process, to distinguish the user's voice signal from ambient noise, device 100 can employ a band-pass filter to filter out noise. For example, suppose that device 100 is surrounded by noise in a construction site. In this case, the use of band pass filtering and/or other signal processing techniques within device 100 to differentiate voice signals from noise can be provisioned. For instance, the band-pass filter can designed to filter out noise outside a band expected for human voice, e.g. the frequency band 300~3,400 Hz, out of audio frequencies in the range of 20~22,000 Hz and thus distinguish the noise and the user's voice signal.

The device 100, detecting the voice signal strength around the first, second, and third mics 102, 103, and 101 separated from noise, determines which one of the mics detects the greatest voice signal strength. Whether the wired headset or wireless headset is used, device 100 converts a first analog voice signal detected by the first mic 102 to a first digital signal, and converts a second analog voice signal detected by the second mic 103 to a second digital signal. A third analog voice signal received from the third microphone 101 is converted to a digital signal by the headset in the case of a wireless headset, and then modulated for wireless transmission and received and demodulated by wireless communication electronics of device 100. The demodulated data signal is a third data signal representing the voice signal level as received by the third mic 101. Device 100 then compares levels of the converted first, second and third digital signals. The comparison operations may be performed by a main chip of the electronic device 100. In the case of a wired headset, the headset may provide the microphone signal as an analog signal to device 100, The main chip of device 100 converts the analog signal to the third digital signal and performs the same comparison of the voice signal levels represented by the first, second and third digital signals.

Next, device 100 disables all of the mics out of mics 101, 102 and 103 except for the mic detecting the greatest voice signal strength. In other words, device 100 disables the two mics detecting the lowest voice signal strengths. Here, when a mic is disabled, the voice signal may continue to be received and monitored, but is not processed and used for communication with the other party. The voice signal received only by the enabled mic is processed and used for communication. Thus, with only the mic detecting the greatest user voice signal enabled among the first, second, and third mics 102, 103, and 101, the user can talk to the other party through the mic of the best transmit sensitivity.

According to the voice signal strengths detected, if the third mic 101 is not the mic having the greatest voice signal strength, then in one embodiment, device 100 selects the first or second mic 102 or 103 having received the greatest signal strength automatically. In an alternative embodiment, device 100 uses an orientation factor to select between the first or second mics 102 and 103. In this case, the electronic device checks positions of the first mic 102 and the second mic 103 using an acceleration sensor. Next, when determining that the detected position is a first set position, the electronic device disables the first mic 102 and the third mic 101. Here, the first set position is one in which the device 100 is oriented vertically and faces forward, such that the first mic 102 is at the bottom and the second mic 103 is at the top as shown in FIG. 1. That is, the first set position is one in which the device 100 is right-side up. When the first set position is detected, and the second mic 103 detects the greater voice signal than the first mic 102 (and is also greater than the third mic), then device 100 enables only the second mic 103 as the mic of the best transmit sensitivity.

However, in the alternative embodiment, when the device 100 is determined to be in a second set position which is upside down or lying horizontally (and when the third mic 101 does not receive the greatest signal strength), the first mic 103 is enabled regardless of whether it receives a higher signal strength than the second mic 102. (The first mic 103 is always selected over the second mic when the device 100 is upside down or lying horizontally)

Considering that the user's location can change in real time, the measurement of the voice signal strength received by the three respective mics and the corresponding selection between them can be done continuously, or at set time intervals, e.g. every fraction of a second, every second or every few seconds.

At each re-check of the signal strengths, when the mic detecting the greatest voice signal strength is currently operating, device 100 retains the current mic. By contrast, when the mic detecting the greatest voice signal strength is not currently operating, device 100 disables the current mic and enables the mic detecting the greatest voice signal strength. Hence, the electronic device can repeat the above-stated operation after each preset time interval in order to detect the user's location which changes in real time, rather than enabling only one of the first, second, and third mics 202, 203, and 201 only when the initial call is connected.

Figure 4A:
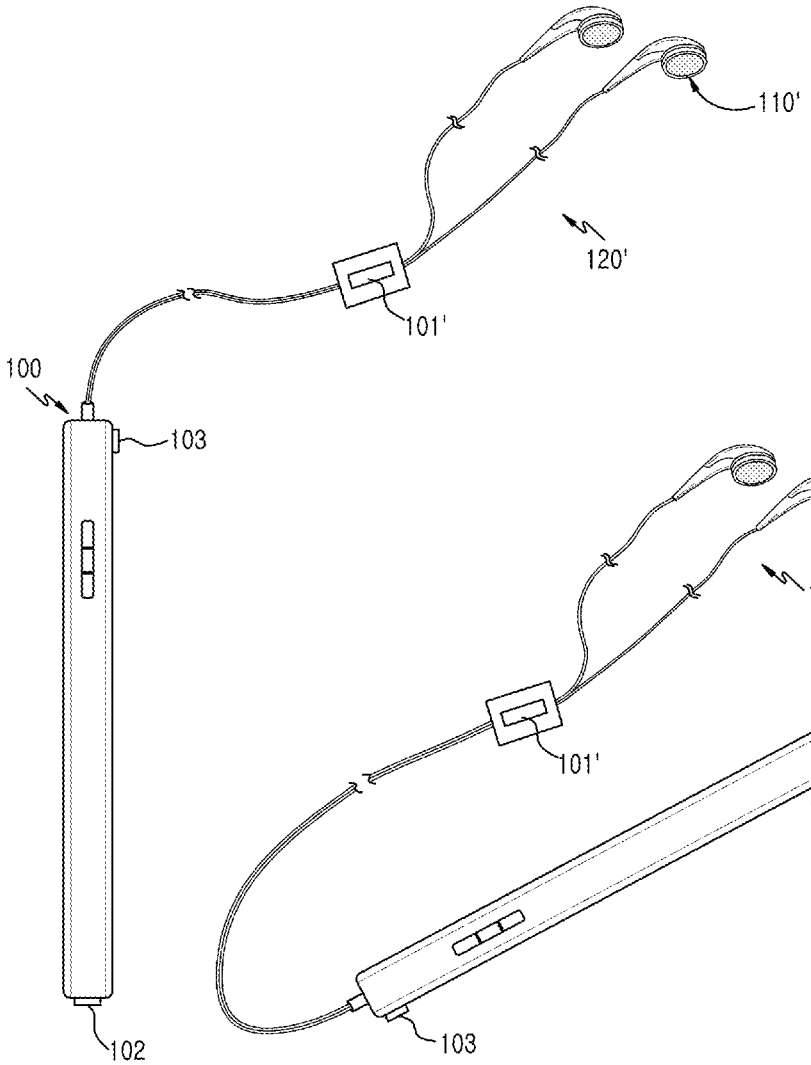
FIGS. 4A and 4B illustrate a scenario in which the mic that receives the highest voice signal strength changes during the course of a communication session, when a wired headset is connected to the electronic device.
Figure 4B:
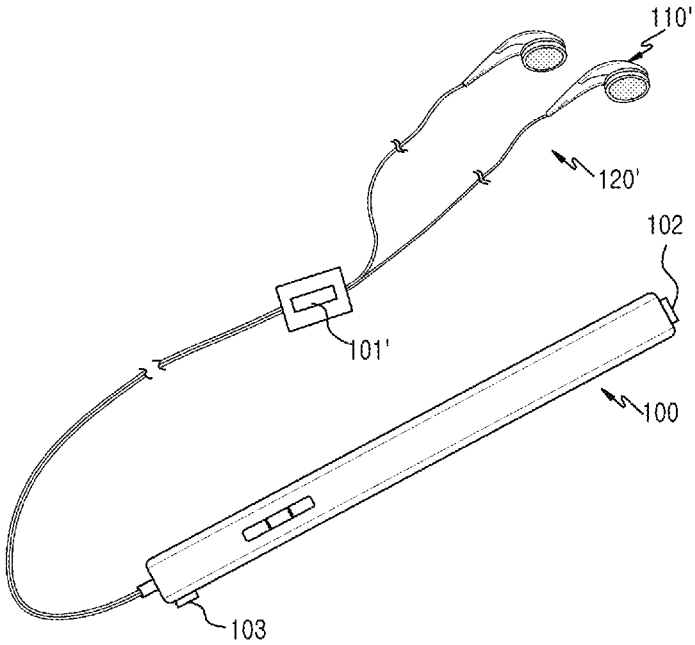

FIGS. 4A and 4B illustrate a scenario in which the mic that receives the highest voice signal strength changes during the course of a communication session. FIG. 4A depicts the electronic device 100 in an upright position and connected to a wired headset 120'. It is assumed that the call is initially connected with the device 100 in the shown orientation.

Since the user is wearing the wired earphones 110' and is assumed to be holding the device 100 away from his or her face, the third mic 101' of the first, second, and third mics 102, 103, and 101' is the closest to the user's lips and therefore detects the greatest voice signal strength.

Accordingly, under these conditions, the device 100 enables the third mic 101' and disables the first and second mics 102, 103, thus maintaining the optimal transmit sensitivity in the communication with the other party of the telephone call.

FIG. 4B depicts the electronic device 100 with the first and second mic positions changed with respect to the voice source. That is, it is assumed that the user continues to wear the headset 120' but has brought the device 100 closer to his or her face. As a result, the relative spatial position between the electronic device 100 and the user's lips changes by a sufficient extent such that at least one of the first and second mics 102, 103 receives a higher voice signal strength than the third mic 101'. As explained in the method described above, since the voice signal strengths of each of the mics is continually monitored and compared with that of the other mics, or is monitored and compared in short predetermined time intervals, as soon as the currently enabled mic is no longer detected as the mic receiving the highest voice signal strength, it is disabled. Simultaneously, the mic that is detected to receive the highest voice signal strength is enabled and used for the current communication session. During this process, as described above, band pass filtering is employed within device 100 to filter out ambient noise incident at each of the mics such that the detected audio that is measured for an amount of signal strength represents primarily the strength of the user's voice and not the surrounding noise.

On the other hand, if the electronic device 100 had enabled all of the first, second, and third mics as is done in some prior art designs, the ambient noise input from the two mics that detect a lower voice signal would be transferred to the other party who is communicating with the user. Embodiments of the present invention avoid this added noise scenario by utilizing the voice signal received at only a single mic.

Figure 5B:
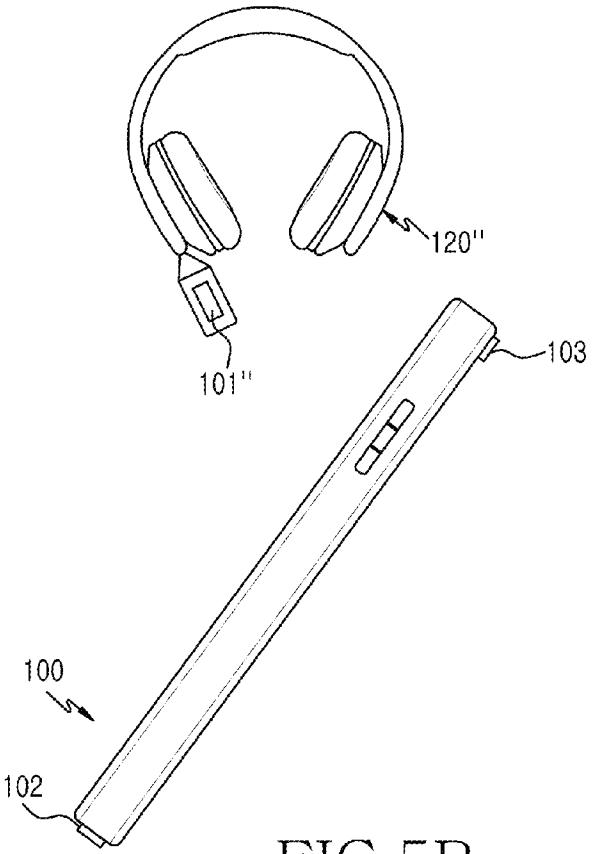
FIGS. 5A and 5B illustrate a scenario in which the mic that receives the highest voice signal strength changes during the course of a communication session, when a wireless headset is communicatively connected to the electronic device.
Figure 5A:
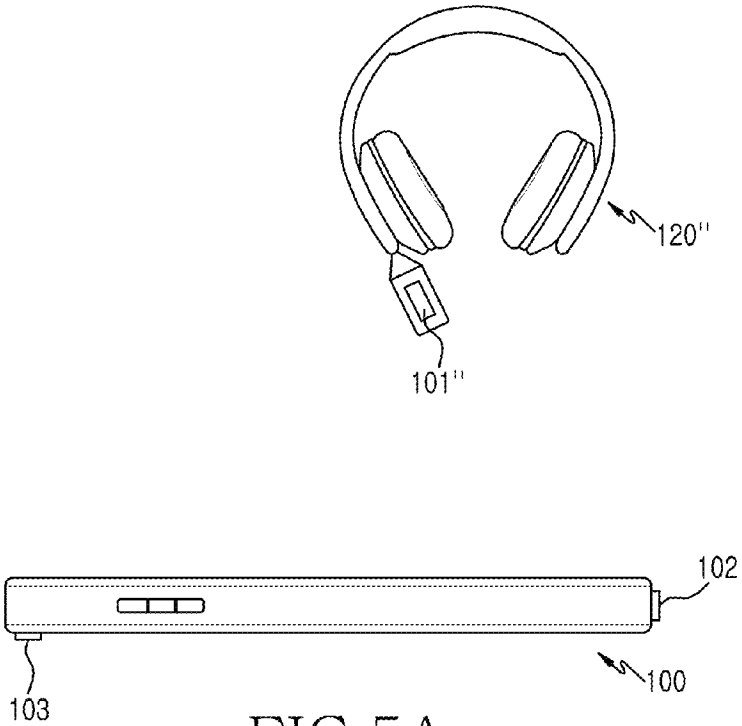

FIGS. 5A and 5B illustrate a scenario in which the mic that receives the highest voice signal strength changes during the course of a communication session, when a wireless headset is communicatively connected. The illustrated scenario is analogous to that of FIGS. 4A and 4B just described. As shown in FIG. 5A, it is assumed that the call is connected with the user wearing the wireless headset 120" which is connected to the electronic device 100 using NFC. In the relative positions between the headset 120" and the device 100, the user's lips are closest to the third mic 101" of headset 120", thus device 100 detects the third mic 101" as the mic receiving the highest voice signal strength among all the mics. Consequently, device 100 enables the third mic 101" while disabling the first and second mics 102, 103 for the communication session. Thereby, optimal transmit sensitivity in the communication with the other party is maintained. Subsequently, as shown in FIG. 5B, the user moves his or her face relative to the device 100 such that the user's lips are closest to one of the first and second mics 102, 103, whereby the third mic 101" is no longer the mic receiving the highest voice signal strength. Device 100 detects this condition and responds by disabling mic 101" while enabling the one mic 102 or 103 that receives the highest signal strength.

Figure 6:
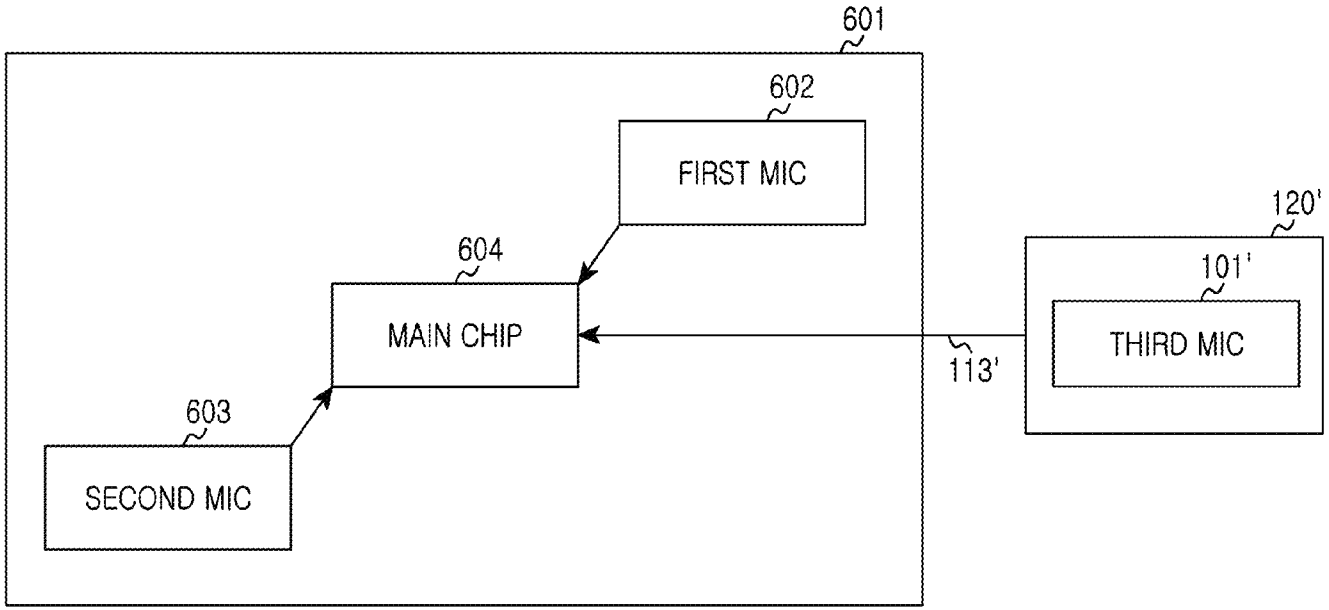
FIG. 6 illustrates relationships between a main chip and first, second, and third mics when the wired headset is connected to the electronic device according to an exemplary embodiment of the present invention.

FIG. 6 depicts relationships between the main chip and the first, second, and third mics when the wired headset 120' is connected to device 100 according to an exemplary embodiment of the present invention. As shown in FIG. 6, the electronic device 601 which is an embodiment of device 100 described above can include a first mic 602, a second mic 603, and a main chip 604. Wired headset 120' includes the third mic 101'. Device 601 includes a main chip 604 coupled to the first and second mics 602, 603. The first mic 602 can detect the voice signal around it. More specifically, to distinguish the user's voice signal from the ambient noise, the first mic 602 can use a band-pass filter. That is, the electronic device 601 can receive primarily the user's voice signal using the band-pass filter which can filter out frequencies outside the frequency band of a typical human voice at the input stages of the first and second mics 602, 603. More specifically, the band-pass filter can identify the human voice band of the frequency band 300~3,400 Hz in the audio frequencies 20~22,000 Hz and thus distinguish the noise and the user's voice signal. Hence, the first mic 602 and second mic 603 distinguish the ambient noise and the user's voice signal and receive the first and second analog voice signals, respectively. The third mic 101' of the wired headset 120' detects the ambient voice signal. More specifically, the third mic 101' detects the voice signal and receives the third analog voice signal. The main chip 604 of the electronic device 601 receives the first, second, and third analog voice signals from the first, second and third mics 602, 603 and 101', respectively, and converts them to first, second, and third digital signals. Next, the electronic device 601 determines which one of the first, second, and third mics 602, 603, and 101' detects the greatest voice signal by comparing the first, second, and third digital signals.

Figure 7:
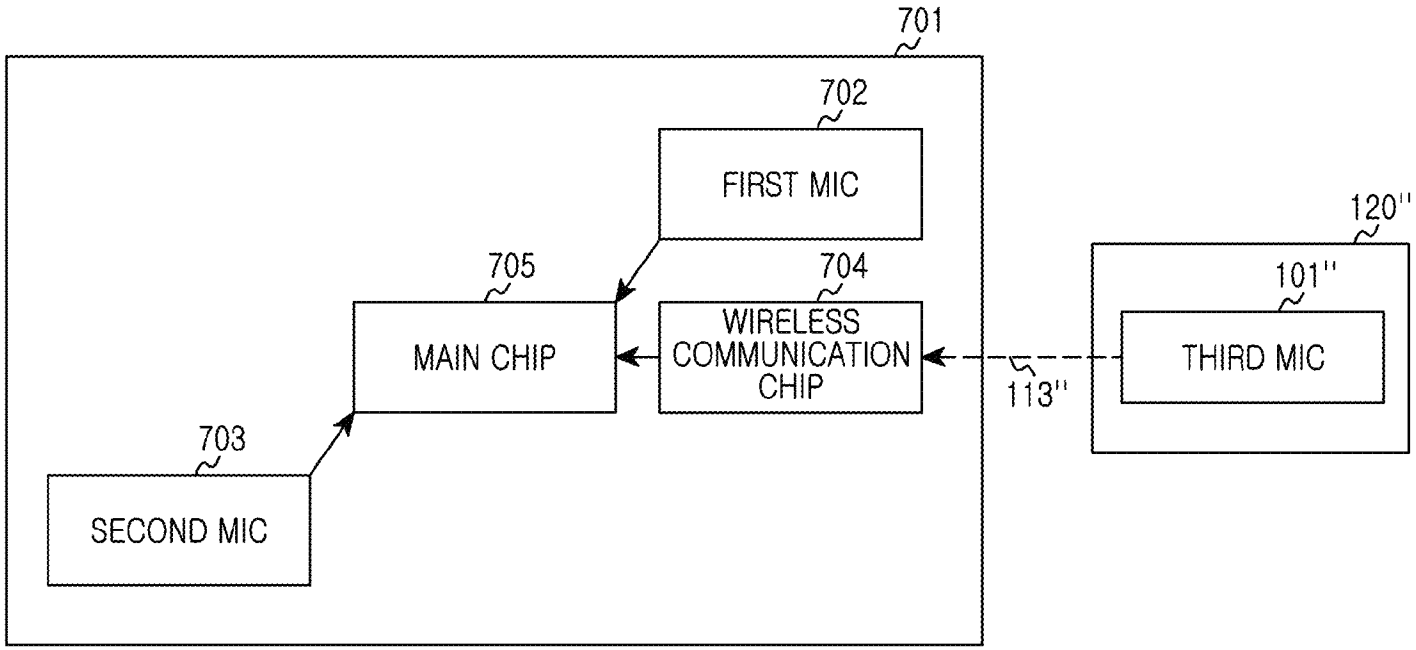
FIG. 7 illustrates relationships between the main chip and the first, second, and third mics when the wireless headset is connected to the electronic device according to an exemplary embodiment of the present invention.

FIG. 7 depicts relationships between the main chip, the wireless communication chip, and the first, second, and third mics when the wireless headset is connected to the electronic device according to an exemplary embodiment of the present invention. As shown in FIG. 7, the electronic device 701 (i.e., an embodiment of device 100) can include a first mic 702, a second mic 703, a wireless communication chip 704, and a main chip 705. Wireless headset 120" includes the third mic 101".

The electronic device 701 includes the first mic 702, the second mic 703, the wireless communication chip 704, and the main chip 705. The first and second mics 702, 703 are assumed to be the same as mics 602, 603 of FIG. 6 just described, thus a description of the functionality of mics 702, 703 is omitted for brevity.

The third mic 101" detects the ambient voice signal and employs a band pass filter to filter out noise as described above. Alternatively, instead of employing a separate band pass filter within the headset 120", a digital band pass filtering technique is used within the main chip 705 or wireless communication chip of device 100 to digitally filter out noise and thereby provide primarily a human voice signal. More specifically, the wireless headset 120" includes a wireless communication chip (not shown) to convert the user's analog voice signal into a data signal representing the instantaneous voice level as a function of time, modulates a carrier in accordance with a NFC protocol with the data signal, and transmits the modulated carrier to device 100 in a conventional manner. For example, if Bluetooth is used, a frequency hopping technique conveys the voice signal data. The wireless communication chip 704 of the electronic device 701 receives and demodulates the modulated NFC signal and converts it to a third digital signal representing the user's voice signal at the level received at the third mic 101". The main chip 705 of the electronic device 701 receives the first and second analog voice signals from the first mic 702 and the second mic 703, and receives the third digital signal from the wireless communication chip 704. Next, the main chip 705 of the electronic device 701 converts the first analog voice signal and the second analog voice signal received from the first mic 702 and the second mic 703 to a first digital signal and a second digital signal respectively. Finally, the electronic device 701 determines which one of the first, second, and third mics 702, 703, and 101" detects the greatest voice signal by comparing the first, second, and third digital signals.

Figure 8:
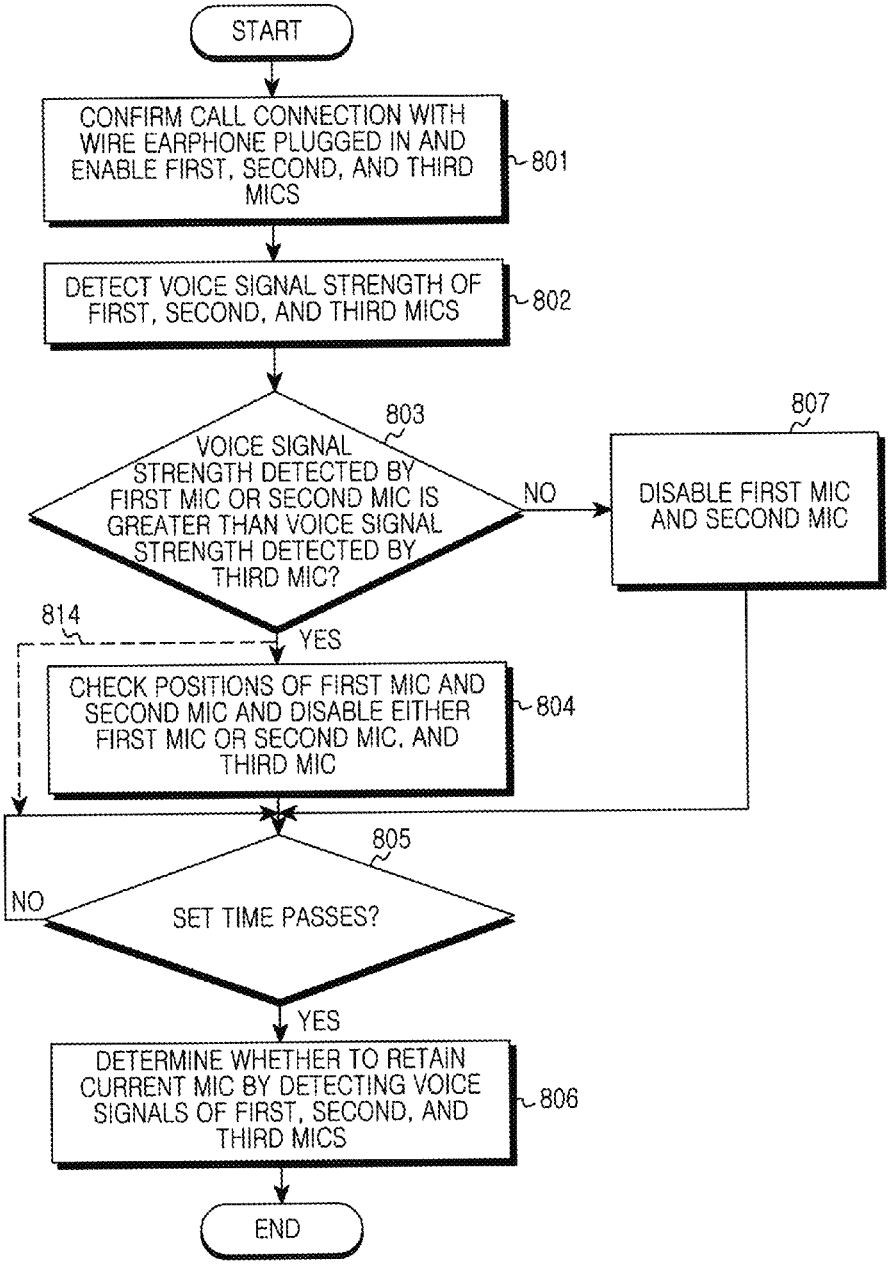
FIG. 8 illustrates an operating method of the electronic device connected with a headset according to an exemplary embodiment of the present invention.

FIG. 8 is a flowchart of an operating method of an electronic device communicatively connected with the wire or wireless headset according to an exemplary embodiment of the present invention. As shown in FIG. 8, the electronic device 100 confirms the call connection with the headset 120 plugged in or wirelessly connected via NFC and initially enables the first, second, and third mics in step 801. More specifically, when the three mics are initially enabled, the voice signals received at each mic are not all sent to the other party. Rather, for the initial enabling, the voice signals received at each mic are measured for signal strength, and only one of the three mics is chosen to convey the voice information to the other party. Since the initial measurement and mic selection only takes a fraction of a second, any delay caused by the process of selecting a mic does not adversely impact the communication session. After one of the mics receiving the greatest signal strength is selected, it is again said to be "enabled," meaning that the voice signals received thereat are forwarded to the other party, while the other mics are "disabled," meaning that the voice signals can still be received thereat and analyzed by device 100 continuously in real time or at periodic intervals, but they are not forwarded to the other party.

In step 802, the electronic device detects the voice signal strength of the first, second, and third mics. More specifically, the electronic device 100 detects the voice signal strength around its first and second mics, and the voice signal strength around the third mic of the headset. Band pass filtering is preferably employed to filter out noise as described above. For example, analog filtering can be used at each microphone, and/or digital filtering is implemented at the main chip of device to extract primarily the voice signal incident at each mic. The analog voice signals with noise filtered out are converted to digital signals, and the respective signal strength levels represented thereby are compared. Alternatively, comparison can be done in an analog environment, at least for the first and second analog signals. (In the case of a wireless headset, since the voice information is already represented as digital data, it may be inefficient to use an analog signal comparison approach.) In step 803, the electronic device determines whether the voice signal strength detected by the first mic or the second mic is greater than the voice signal strength detected by the third mic. More specifically, device 100 can determine whether the voice signal strength detected by the first mic or the second mic is greater than the voice signal strength detected by the third mic by comparing the first, second, and third digital signals (or alternatively via an analog signal comparison as mentioned above).

When the voice signal strength detected by the first mic or the second mic is greater than the voice signal strength detected by the third mic in step 803, the electronic device 100 in one embodiment checks the positions of the first mic and the second mic and disables either the first mic or the second mic, and the third mic in step 804. More specifically, when the voice signal strength detected by the first mic or the second mic is greater than the voice signal strength detected by the third mic, the electronic device checks the positions of the first mic and the second mic using the acceleration sensor. Next, when the checked position is the first set position, the electronic device disables the first mic and the third mic. (In another embodiment, step 804 is skipped, as indicated by path 814, so that mic position determination is not a factor in mic selection.)

Here, the first set position specifies that the electronic device stands vertically and faces forward. That is, the first set position can specify that the electronic device stands upright and faces forward such that the first mic comes to the bottom and the second mic comes to the top. In conclusion, when the second mic detects the greater voice signal than the first mic, the electronic device enables only the second mic of the best transmit sensitivity. When determining that the checked position is the second set position, the electronic device disables the second mic and the third mic. Here, the second set position is one in which the electronic device is put down or is oriented upside down. That is, in the second set position, device 100 is upside down such that the first mic is higher than the second mic, as opposed to the first position, or, device 100 is oriented horizontally. In conclusion, when the first mic detects the greater voice signal than the second mic, the electronic device enables only the first mic of the better transmit sensitivity.

In step 805, the electronic device determines whether the set time passes. Here, the electronic device determines whether the set time passes in order to redetect the voice signal of the first, second, and third mics according to the spatial position change of the electronic device and the user's position change in real time. Alternatively, the respective voice signals are continuously monitored, such that as soon as a change in mic receiving the highest signal strength is detected, the enabled and disabled mics are changed.

When the set time passes, the electronic device determines whether to retain the current mic by detecting the voice signals of the first, second, and third mics in step 806. More specifically, after the set time, the electronic device detects only the voice signal strength of the first, second, and third mics and determines which one of the first, second, and third mics detects the greatest voice signal strength. Next, the electronic device determines whether the mic detecting the greatest voice signal strength is currently operating. When the mic detecting the greatest voice signal strength is currently operating, the electronic device retains the current mic. By contrast, when the mic detecting the greatest voice signal strength is not currently operating, the electronic device disables the current mic and enables the mic detecting the greatest voice signal strength. Hence, the electronic device periodically redetect the voice signals of the first, second, and third mics according to the spatial position change of the electronic device and the user's position change in real time, rather than enabling just one of the first, second, and third mics only when the initial call is connected.

When the voice signal strength detected by the first mic or the second mic is smaller than the voice signal strength detected by the third mic in step 803, the electronic device disables the first mic and the second mic and determines whether the set time passes in step 805. When the set time does not pass in step 805, the electronic device repeatedly determines whether the set time passes.

Figure 9:
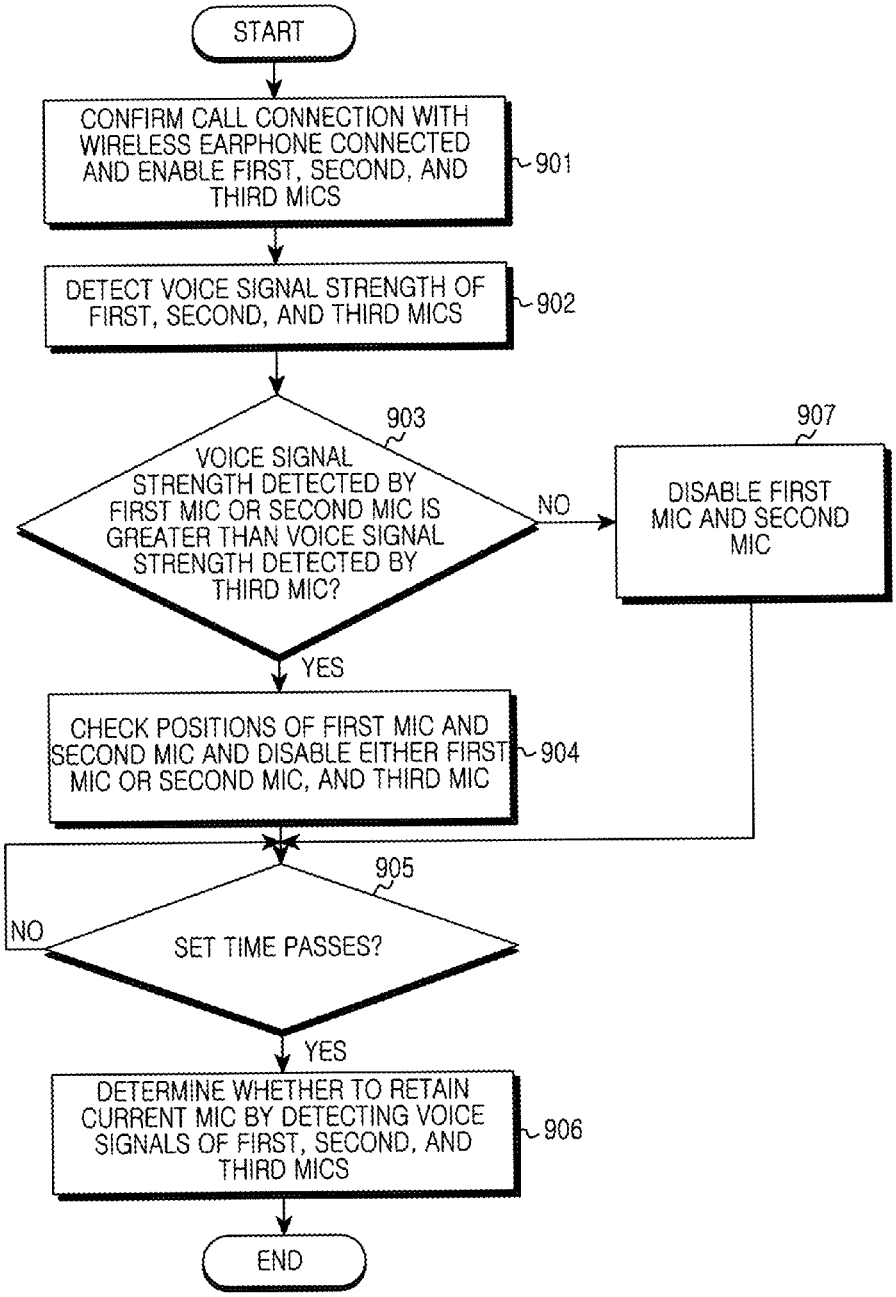
FIG. 9 illustrates an operating method of the electronic device connected with the wireless earphone according to an exemplary embodiment of the present invention.

FIG. 9 is a flowchart of an operating method of the electronic device connected with the wireless earphone according to an exemplary embodiment of the present invention. As shown in FIG. 9, the electronic device confirms the call connection with the wireless earphone connected and enables the first, second, and third mics in step 901. More specifically, upon confirming the call connection, the electronic device can enable the first mic and the second mic of the electronic device and the third mic of the wireless earphone. Herein, the first mic may be referred to as the main mic, and the second mic may be referred to as the sub mic. That is, the electronic device can include the dual mic.

In step 902, the electronic device detects the voice signal strength of the first, second, and third mics. More specifically, the electronic device detects the voice signal strength around its first and second mics, and the voice signal strength around the third mic of the wireless earphone. The electronic device can receive only the user's voice signal using the band-pass filter which can filter only the frequency band of the human at the input stages of the first and second mics. More specifically, the band-pass filter can identify the human voice band of the frequency band 300~3,400 Hz in the audio frequencies 20~22,000 Hz and thus distinguish the noise and the user's voice signal. Hence, the first mic and the second mic distinguish the ambient noise and the user's voice signal and receive the first analog voice signal and the second analog voice signal respectively.

In step 903, the electronic device determines whether the voice signal strength detected by the first mic or the second mic is greater than the voice signal strength detected by the third mic. More specifically, the main chip of the electronic device, which is connected to the first mic and the second mic, receives the first, second, and third analog voice signals from the first, second, and third mics and converts them to the first, second, and third digital signals. Next, the electronic device can compare the first, second, and third digital signals and thus determine whether the voice signal strength detected by the first mic or the second mic is greater than the voice signal strength detected by the third mic.

When the voice signal strength detected by the first mic or the second mic is greater than the voice signal strength detected by the third mic in step 903, the electronic device checks the positions of the first mic and the second mic and disables either the first mic or the second mic, and the third mic in step 904. More specifically, when the voice signal strength detected by the first mic or the second mic is greater than the voice signal strength detected by the third mic, the electronic device checks the positions of the first mic and the second mic using the acceleration sensor. Next, when the checked position is the first set position, the electronic device disables the first mic and the third mic. Herein, the first set position specifies that the electronic device stands vertically and faces forward. That is, the first set position can specify that the electronic device stands upright and faces forward such that the first mic comes to the bottom and the second mic comes to the top. In conclusion, when the second mic detects the greater voice signal than the first mic, the electronic device enables only the second mic of the best transmit sensitivity. When determining that the checked position is the second set position, the electronic device disables the second mic and the third mic. Herein, the second set position specifies that the electronic device is put down or stands upside down. That is, the second set position can specify that the electronic device stands such that the first mic comes to the top and the second mic comes to the bottom, as opposed to the first position, or that the electronic device is put down. In conclusion, when the first mic detects the greater voice signal than the second mic, the electronic device enables only the first mic of the best transmit sensitivity.

In step 905, the electronic device determines whether the set time passes. Herein, the electronic device determines whether the set time passes in order to redetect the voice signal of the first, second, and third mics according to the spatial position change of the electronic device and the user's position change in real time. When the set time passes, the electronic device determines whether to retain the current mic by detecting the voice signals of the first, second, and third mics in step 906. More specifically, after the set time, the electronic device detects only the voice signal strength of the first, second, and third mics and determines which one of the first, second, and third mics detects the greatest voice signal strength. Next, the electronic device determines whether the mic detecting the greatest voice signal strength is currently operating. When the mic detecting the greatest voice signal strength is currently operating, the electronic device retains the current mic. By contrast, when the mic detecting the greatest voice signal strength is not currently operating, the electronic device disables the current mic and enables the mic detecting the greatest voice signal strength. Hence, the electronic device periodically redetect the voice signals of the first, second, and third mics according to the spatial position change of the electronic device and the user's position change in real time, rather than enabling just one of the first, second, and third mics only when the initial call is connected.

When the voice signal strength detected by the first mic or the second mic is smaller than the voice signal strength detected by the third mic in step 903, the electronic device disables the first mic and the second mic and determines whether the set time passes in step 905. When the set time does not pass in step 905, the electronic device repeatedly determines whether the set time passes.

Figure 10:
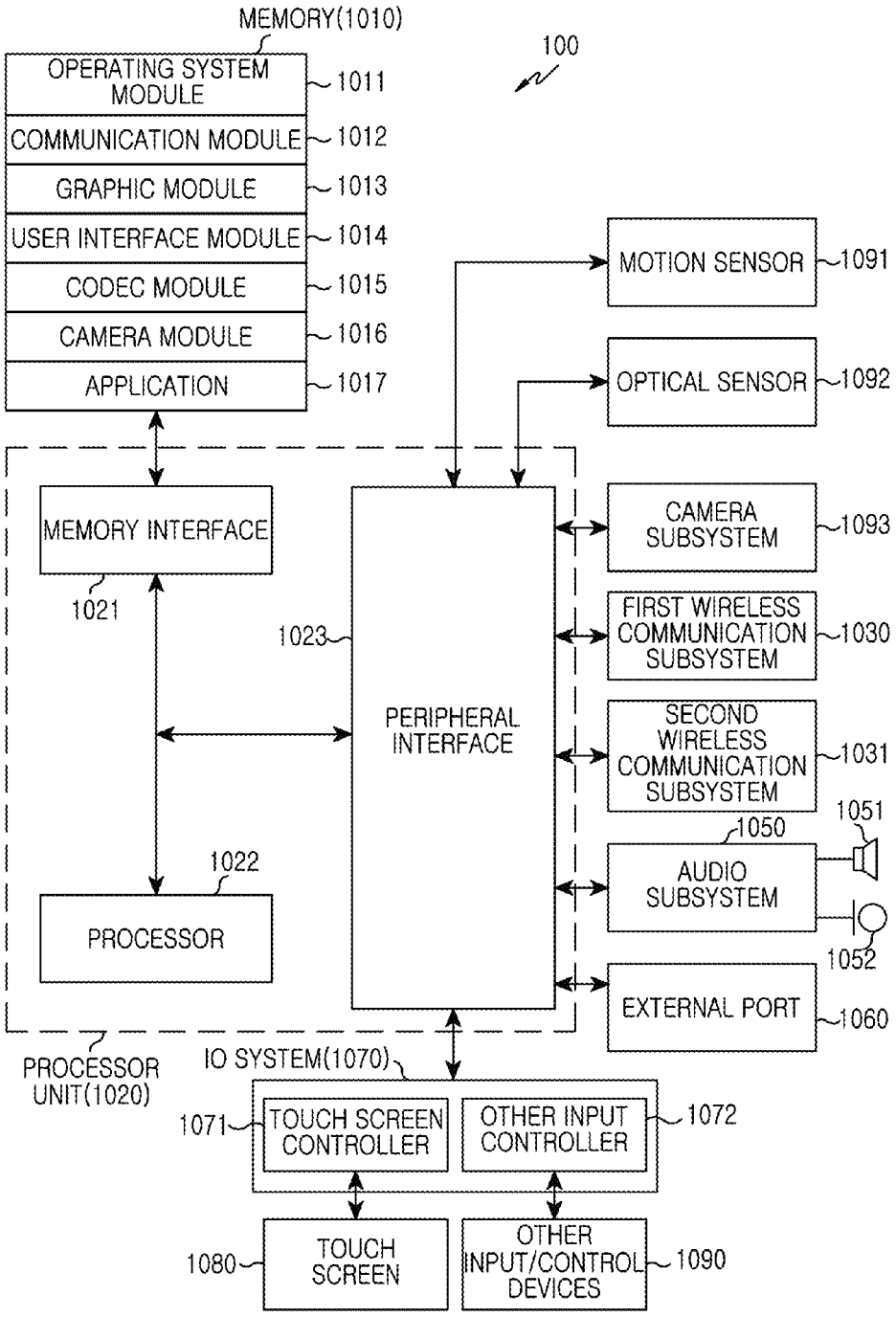
FIG. 10 illustrates the electronic device according to an exemplary embodiment of the present invention.

FIG. 10 is a block diagram of the electronic device 100 according to an exemplary embodiment of the present invention. Device 100 can be a portable electronic device such as portable terminal, mobile phone, mobile pad, media player, tablet computer, handheld computer, or Personal Digital Assistant (PDA). Device 100 may be a portable electronic device combining two or more functions of those devices.

Device 100 includes a memory 1010, a processor unit 1020, a first wireless communication subsystem 1030, a second wireless communication subsystem 1031, an external port 1060, an audio subsystem 1050, a speaker 1051, a mic 1052, an Input Output (IO) system 1070, a touch screen 1080, and other input or control devices 1090. A plurality of memories 1010 and a plurality of external ports 1060 can be used.

The processor unit 1020 can include a memory interface 1021, one or more processors 1022, and a peripheral interface 1023. In some cases, the processor unit 1020 may be referred to as the processor. The processor unit 1020 determines which one of the first, second, and third mics detects the greatest voice signal strength and disables the two mics except for the mic detecting the greatest voice signal strength. The processor unit 1020 confirms the call connection, enables the first, second, and third mics, confirms that the third mic belongs to the wired headset, converts the first analog voice signal detected by the first mic to the first digital signal, converts the second analog voice signal detected by the second mic to the second digital signal, converts the third analog voice signal received from the wired headset to the third digital signal, and compares the levels of the converted first, second and third digital signals. The processor unit 1020 determines which one of the first, second, and third mics detects the greatest voice signal strength. When a wireless headset is communicatively connected, processor unit 1020 confirms that the third mic belongs to the wireless headset, converts the first analog voice signal detected by the first mic to the first digital signal, converts the second analog voice signal detected by the second mic to the second digital signal, converts the demodulated NFC data signal received from the wireless headset to the third digital signal, and compares the levels of the converted first, second and third digital signals. The processor unit 1020 in an embodiment variant determines that the voice signal strength detected by the first mic or the second mic is greater than the voice signal strength detected by the third mic, and disables the first mic and the third mic when the checked position is the first set position. The processor unit 1020 in the embodiment variant determines that the voice signal strength detected by the first mic or the second mic is greater than the voice signal strength detected by the third mic, and disables the second mic and the third mic when the checked position is the second set position. The processor unit 1020 confirms that the set time passes, determines which one of the first, second, and third mics detects the greatest voice signal strength, and determines whether the mic detecting the greatest voice signal strength is currently operating. When the mic detecting the greatest voice signal strength is currently operating, the processor unit 1020 retains the current mic. When the mic detecting the greatest voice signal strength is not currently operating, the processor unit 1020 disables the current mic and enables the mic detecting the greatest voice signal strength.

The processor 1022 performs various functions for the electronic device 100 by running various software programs, and processes and controls voice communication and data communication. In addition to such typical functions, the processor 1022 also executes particular software modules (instruction sets) stored in memory 1010 and performs various particular functions corresponding to the modules. That is, the processor 1022 carries out methods according to exemplary embodiments of the present invention in association with the software modules stored in the memory 1010.

The processor 1022 can include one or more data processors, an image processor, or a CODEC. The data processor, the image processor, or the CODEC may be separately provided. Alternatively, the processor 1022 may include a plurality of processors for performing different functions. The peripheral interface 1023 connects the IO subsystem 1070 of the electronic device 100 and various peripherals to the processor 1022 and the memory 1010 (through the memory interface 1021).

The various components of the electronic device 100 can be coupled using one or more communication buses or one or more stream lines.

The external port 1060 is used to connect the portable electronic device to another electronic device(s) directly or indirectly via a network (e.g., Internet, intranet, and wireless LAN). The external port 1060 can be, for example, but not limited to, a Universal Serial Bus (USB) port or a FIREWIRE port.

A motion sensor 1091 and an optical sensor 1092 are coupled to the peripheral interface 1023 to allow various functions. For example, the motion sensor 1091 and the optical sensor 1092 are coupled to the peripheral interface 1023 to detect motion of the electronic device and the light from the outside. Besides these, a positioning system and other sensors such as temperature sensor or bionic sensor can be coupled to the peripheral interface 1023 to perform their functions.

A camera subsystem 1093 performs camera functions such as photo and video clip recording.

The optical sensor 1092 can employ a Charged Coupled Device (CCD) or a Complementary Metal-Oxide Semiconductor (CMOS) device.

The communication function is conducted through the one or more wireless communication subsystems 1030 and 1031. The wireless communication subsystems 1030 and 1031 can include radio frequency (RF) receiver and transmitter and/or optical (e.g., infrared light) receiver and transmitter. The first wireless communication subsystem 1030 and the second wireless communication subsystem 1031 can be distinguished based on the communication network of the electronic device 100. For example, the communication network can include a communication subsystem designed to operate over, but not limited to, a Global System for Mobile communication (GSM) network, an Enhanced Data GSM Environment (EDGE) network, a Code Division Multiple Access (CDMA) network, a W-CDMA network, a Long Term Evolution (LTE) network, an Orthogonal Frequency Division Multiple Access (OFDM) network, a Wireless Fidelity (Wi-Fi) network, a WiMax network and/or a Bluetooth network. The first wireless communication subsystem 1030 and the second wireless communication subsystem 1031 may be integrated into a single wireless communication subsystem.

The audio subsystem 1050 can be coupled to the speaker 1051 and the mic 1052 to process audio stream input and output such as voice recognition, voice reproduction, digital recording, and telephone function. That is, the audio subsystem 1050 communicates with the user through the speaker 1051 and the mic 1052. The audio subsystem 1050 receives a data signal through the peripheral interface 1023 of the processor unit 1020 and converts the received data signal to an electric signal. The converted electric signal is fed to the speaker 1051. The speaker 1051 converts the electric signal to a sound wave audible by the user and outputs the sound wave. The mic 1052 converts the sound wave from the user or other sound sources to an electric signal. The audio subsystem 1050 receives the converted electric signal from the mic 1052. Mic 1052 comprises a main mic disposed at a bottom portion of device 100, and a sub mic disposed at a top portion of the device. The audio subsystem 1050 converts the received electric signal to the audio data signal and sends the converted audio data signal to the peripheral interface 1023. The audio subsystem 1050 can include an attachable and detachable ear phone, head phone, or head set.

The IO subsystem 1070 can include a touch screen controller 1071 and/or an other input controller 1072. The touch screen controller 1071 can be coupled to the touch screen 1080. The touch screen 1080 and the touch screen controller 1071 can detect the contact and the motion or their abortion using, but not limited to, capacitive, resistive, infrared and surface sound wave techniques for determining one or more contact points with the touch screen 1080 and a multi-touch detection technique including various proximity sensor arrays or other elements. The other input controller 1072 can be coupled to the other input/control devices 1090. The other input/control devices 1090 can employ one or buttons, a rocker switch, a thumb wheel, a dial, a stick, and/or a pointer such as stylus.

The touch screen 1080 provides the I/O interface between the electronic device 100 and the user. That is, the touch screen 1080 forwards the user's touch input to the electronic device 100. The touch screen 1080 also functions as a medium for displaying the output of the electronic device 100 to the user. That is, the touch screen 1080 represents a visual output to the user. Such a visual output can be represented as text, graphic, video, and a combination of these.

The touch screen 1080 can employ various displays, examples of which include, but are not limited to, Liquid Crystal Display (LCD), Light Emitting Diode (LED), Light emitting Polymer Display (LPD), Organic LED (OLED), Active Matrix OLED (AMOLED) or Flexible LED (FLED).

The memory 1010 can be coupled to the memory interface 1021. The memory 1010 can include fast random access memory (RAM) such as one or more magnetic disc storage devices and/or non-volatile memory, one or more optical storage devices, and/or a flash memory (e.g., NAND and NOR).

The memory 1010 stores software. Software components include an operating system module 1011, a communication module 1012, a graphic module 1013, a user interface module 1014, a MPEG module 1015, a camera module 1016, and one or more application modules 1017. The modules being the software components can be represented as a set of instructions, and thus the module can be referred to as an instruction set. Also, the module may be referred to as a program. The operating system software 1011 (the embedded operating system such as WINDOWS, LINUX, Darwin, RTXC, UNIX, OS X, or VxWorks) includes various software components for controlling general system operations. These include, e.g., memory management and control, storage hardware (device) control and management, and power control and management. The operating system software 1011 processes the normal communication between various hardware (devices) and software components (modules).

The communication module 1012 allows communication with other electronic devices such as a computer, server, and/or portable terminal, through the wireless communication subsystems 1030 and 1031 or the external port 1060.

The graphic module 1013 includes various software components for providing and displaying graphics on the touch screen 1080. The term 'graphics' encompasses text, webpage, icon, digital image, video, and animation.

The user interface module 1014 includes various software components relating to a user interface. The user interface module 1014 is involved in the status change of the user interface and the condition of the user interface status change.

The CODEC module 1015 can include software components relating to video file encoding and decoding. The CODEC module 1015 can include a video stream module such as MPEG module and/or H204 module. The CODEC module 1015 can include various audio file CODEC modules for AAA, AMR, and WMA. The CODEC module 1015 includes instruction sets corresponding to the methods of the present invention as described herein.

The camera module 1016 includes camera related software components allowing camera related processes and functions.

The application module 1017 includes a browser, an e-mail, an instant message, a word processing, keyboard emulation, an address book, a touch list, a widget, Digital Right Management (DRM), voice recognition, voice reproduction, a position determining function, and a location based service.

The various functions of the electronic device 100 as stated above and to be explained, can be executed by hardware and/or software and/or their combination including one or more stream processing and/or Application Specific Integrated Circuits (ASICs).

As set forth above, an electronic device and the method for selecting a mic by detecting the voice signal strength dynamically adapts to the user's position varying in real time and thus automatically selects the mic of the best receive sensitivity. Therefore, the user's convenience can be elevated.

While the invention has been shown and described with reference to certain exemplary embodiments thereof, it will be understood by those skilled in the art that various changes in form and details may be made therein without departing from the spirit and scope of the invention as defined by the appended claims and their equivalents. For example, as an alternative to the dual mic configuration of electronic device 100, only a single mic may be employed, whereby the methods described above would compare signal strength between the headset mic and only the single mic of the electronic device and dynamically select the mic receiving the highest voice signal strength. In yet another alternative, three or more mics are incorporated within the electronic device, and the methods select among the three or more mics and the headset mic in an analogous manner to those of the methods described above.

What is claimed is:

1. An operating method of an electronic device communicatively connected to a headset, comprising:

detecting a respective voice signal strength received at each of at least first, second, and third mics, wherein the first and second mics are part of the electronic device and the third mic is part of the headset;

determining which one of the at least first, second, and third mics detects the greatest voice signal strength; and disabling mics except for the mic detecting the greatest voice signal strength.

2. The operating method of claim 1, further comprising:

confirming that a call is connected; and initially enabling the first, second, and third mics.

3. The operating method of claim 1, wherein the first mic is a main mic.

4. The operating method of claim 1, wherein the second mic is a sub mic.

5. The operating method of claim 1, wherein the headset is a wired or wireless headset.

6. The operating method of claim 1, wherein determining which one of the first, second, and third mics detects the greatest voice signal strength comprises:

determining that the third mic is a mic of a wired headset;

converting a first analog voice signal detected by the first mic to a first digital signal;

converting a second analog voice signal detected by the second mic to a second digital signal;

converting a third analog voice signal received from the wired headset to a third digital signal; and comparing levels of the converted first, second, and third digital signals.

7. The operating method of claim 1, wherein the determining of which one of the first, second, and third mics detects the greatest voice signal strength comprises:

determining that the third mic is a mic of a wireless headset;

converting a first analog voice signal detected by the first mic to a first digital signal;

converting a second analog voice signal detected by the second mic to a second digital signal;

converting a near field communication (NFC) signal received from the wireless headset to a third digital signal; and comparing levels of the converted first, second, and third digital signals.

8. The operating method of claim 1, wherein the disabling of all the mics except for the mic detecting the greatest voice signal strength comprises:

determining that the voice signal detected by the first mic or the second mic is greater than the voice signal detected by the third mic;

checking positions of the first mic and the second mic using an acceleration sensor; and when determining that the checked position is a first set position, disabling the first mic and the third mic.

9. The operating method of claim 1, wherein the disabling of the two mics except for the mic detecting the greatest voice signal strength comprises:

determining that the voice signal detected by the first mic or the second mic is greater than the voice signal detected by the third mic;

checking positions of the first mic and the second mic using an acceleration sensor; and when determining that the checked position is a second set position, disabling the second mic and the third mic.

10. The operating method of claim 1, further comprising:

determining that a set time passes;

again detecting voice signal strength of the first, second, and third mics;

determining which one of the first, second, and third mics detects the greatest voice signal strength; and determining whether the mic detecting the greatest voice signal strength is currently operating; if so, retaining the current mic; if not, disabling the current mic and enabling the mic detecting the greatest voice signal strength.

11. The operating method of claim 1, wherein detecting a respective voice signal strength comprises band pass filtering audio signals received at the first, second and third mics to filter out noise and obtain primarily voice signals from which the respective voice signal strengths are determined.

12. An electronic device communicatively connectable to a headset having a third mic, the electronic device comprising:

at least first and second mics, each for detecting a respective voice signal strength; and a processor unit configured to determine which one of the at least first, second, and third mics detects the greatest voice signal strength, and disabling all of the mics for communication except for the mic detecting the greatest voice signal strength.

13. The electronic device of claim 12, wherein the processor unit determines that a call is connected, and initially enables the first, second, and third mics.

14. The electronic device of claim 12, wherein the first mic is a main mic.

15. The electronic device of claim 12, wherein the second mic is a sub mic.

16. The electronic device of claim 12, wherein the processor unit determines that the third mic is a mic of a wired headset, converts a first analog voice signal detected by the first mic to a first digital signal, converts a second analog voice signal detected by the second mic to a second digital signal, and converts a third analog voice signal received from the wired headset to a third digital signal, and compares levels of the converted first, second, and third digital signals.

17. The electronic device of claim 12, wherein the processor unit determines which one of the first, second, and third mics detects the greatest voice signal strength, determines that the third mic is a mic of a wireless headset, converts a first analog voice signal detected by the first mic to a first digital signal, converts a second analog voice signal detected by the second mic to a second digital signal, converts a near field communication (NFC) signal received from the wireless earphone to a third digital signal, and compares levels of the converted first, second, and third digital signals.

18. The electronic device of claim 12, further comprising:

an acceleration sensor for checking positions of the first mic and the second mic, wherein the processor unit determines that the voice signal strength detected by the first mic or the second mic is greater than the voice signal strength detected by the third mic, and disables the first mic and the third mic when determining that the checked position is a first set position.

19. The electronic device of claim 12, further comprising:

an acceleration sensor for checking positions of the first mic and the second mic, wherein the processor unit determines that the voice signal strength detected by the first mic or the second mic is greater than the voice signal strength detected by the third mic, and disables the second mic and the third mic when determining that the checked position is a second set position.

20. The electronic device of claim 12, wherein the first, second, and third mics detect only the voice signal strength, and the processor unit determines that a set time passes, determines which one of the first, second, and third mics detects the greatest voice signal strength, and determines whether the mic detecting the greatest voice signal strength is currently operating; if so, the current mic is retained; if not, the current mic is disabled for communication and the mic detecting the greatest voice signal strength is enabled.

* * * * *